US008965703B2

(12) United States Patent
Prakash et al.

(10) Patent No.: US 8,965,703 B2
(45) Date of Patent: Feb. 24, 2015

(54) APPLICATIONS BASED ON FLUID PROPERTIES MEASURED DOWNHOLE

(75) Inventors: Ankur Prakash, Lucknow (IN); John C. Rasmus, Richmond, TX (US); Richard J. Radtke, Pearland, TX (US); Michael Evans, Missouri City, TX (US); Lee Dolman, L'Etang la Ville (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 602 days.

(21) Appl. No.: 13/251,769

(22) Filed: Oct. 3, 2011

(65) Prior Publication Data

US 2013/0085675 A1 Apr. 4, 2013

(51) Int. Cl.

| | |
|---|---|
| ***G01V 1/48*** | (2006.01) |
| ***G01V 1/50*** | (2006.01) |
| ***G01N 15/10*** | (2006.01) |
| ***E21B 47/12*** | (2012.01) |
| ***E21B 49/00*** | (2006.01) |

(52) U.S. Cl.

CPC ..... *E21B 49/003* (2013.01)
USPC ..... 702/9; 702/11; 702/12; 73/152.03

(58) Field of Classification Search

USPC ..... 702/9, 11, 12; 73/152.03, 152.04
See application file for complete search history.

(56) References Cited

U.S. PATENT DOCUMENTS

| | | | | |
|---|---|---|---|---|
| 4,878,382 | A | 11/1989 | Jones et al. | |
| 4,879,654 | A | 11/1989 | Bruce | |
| 4,899,112 | A | 2/1990 | Clark et al. | |
| 5,070,949 | A * | 12/1991 | Gavignet | 175/48 |
| 6,176,323 | B1 | 1/2001 | Weirich et al. | |
| 6,581,455 | B1 * | 6/2003 | Berger et al. | 73/152.55 |
| 6,648,083 | B2 | 11/2003 | Evans et al. | |
| 6,768,106 | B2 | 7/2004 | Gzara et al. | |
| 7,093,662 | B2 * | 8/2006 | deBoer | 166/358 |
| 7,290,443 | B2 | 11/2007 | Follini et al. | |
| 7,367,411 | B2 * | 5/2008 | Leuchtenberg | 175/48 |
| 7,492,664 | B2 * | 2/2009 | Tang et al. | 367/31 |
| 2004/0060738 | A1 * | 4/2004 | Hemphill | 175/40 |
| 2006/0201714 | A1 * | 9/2006 | Seams et al. | 175/65 |
| 2007/0144740 | A1 * | 6/2007 | Guo et al. | 166/254.2 |
| 2012/0179379 | A1 * | 7/2012 | Alshawaf et al. | 702/9 |

OTHER PUBLICATIONS

International Search Report and Written Opinion issued in International Patent Application No. PCT/US2012/058392 on Jan. 30, 2013, 11 pages.

* cited by examiner

*Primary Examiner* — Michael Nghiem
*Assistant Examiner* — Alexander Satanovsky
(74) *Attorney, Agent, or Firm* — Cathy Hewitt

(57) ABSTRACT

Downhole drilling fluid measurements are made as a function of time or as a function of depth. A change in the downhole drilling fluid measurements is correlated to a feature of a formation penetrated by a drill bit or to a feature of fluids in the formation. The downhole drilling fluid measurements may include density, photoelectric factor, hydrogen index, salinity, thermal neutron capture cross section (Sigma), resistivity, slowness, slowing down time, sound velocity, and elemental composition. The feature may include fluid balance, hole-cleaning, a kick, a shallow water flow, a formation fluid property, formation fluid typing, geosteering, geostopping, or an environmental correction. A downhole system has a measurement-while-drilling tool or a logging-while-drilling tool and a processor capable of obtaining the downhole drilling fluid measurements and correlating the change in the downhole drilling fluid measurements.

12 Claims, 9 Drawing Sheets

APPLICATIONS BASED ON FLUID PROPERTIES MEASURED DOWNHOLE

RELATED APPLICATIONS

N/A

BACKGROUND

Logging tools have long been used in wellbores to make, for example, formation evaluation measurements to infer properties of the formations surrounding the borehole and the fluids in the formations. Common logging tools include electromagnetic tools, nuclear tools, and nuclear magnetic resonance (NMR) tools, though various other tool types are also used.

Early logging tools were run into a wellbore on a wireline cable, after the wellbore had been drilled. Modern versions of such wireline tools are still used extensively. However, the need for information while drilling the borehole gave rise to measurement-while-drilling (MWD) tools and logging-while-drilling (LWD) tools. By collecting and processing such information during the drilling process, the driller can modify or correct key steps of the operation to optimize performance.

MWD tools typically provide drilling parameter information such as weight on the bit, torque, temperature, pressure, direction, and inclination. LWD tools typically provide formation evaluation measurements such as resistivity, porosity, and NMR distributions. MWD and LWD tools often have components common to wireline tools (e.g., transmitting and receiving antennas), but MWD and LWD tools must be constructed to not only endure but to operate in the harsh environment of drilling. The terms MWD and LWD are often used interchangeably, and the use of either term in this disclosure will be understood to include both the collection of formation and wellbore information, as well as data on movement and placement of the drilling assembly.

One technique to measure the properties of the drilling fluid downhole has been patented by Evans et al (U.S. Pat. No. 6,648,083). Application of drilling fluid measurements to kick detection and cuttings bed build-up has been patented by Gzara et al (U.S. Pat. No. 6,768,106). These applications are based on comparing sensor readings at the same depth, but with the tool oriented in different directions.

SUMMARY

Downhole drilling fluid measurements are made as a function of time or as a function of depth. A change in the downhole drilling fluid measurements is correlated to a feature of a formation penetrated by a drill bit or to a feature of fluids in the formation. The downhole drilling fluid measurements may include density, photoelectric factor, hydrogen index, salinity, thermal neutron capture cross section (Sigma), resistivity, slowness, slowing down time, sound velocity, and elemental composition. The feature may include fluid balance, hole-cleaning, a kick, a shallow water flow, a formation fluid property, formation fluid typing, geosteering, geostopping, or an environmental correction. A downhole system has a measurement-while-drilling tool or a logging-while-drilling tool and a processor capable of obtaining the downhole drilling fluid measurements and correlating the change in the downhole drilling fluid measurements. This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Embodiments of applications based on fluid properties measured downhole are described with reference to the following figures. The same numbers are used throughout the figures to reference like features and components.

It should be understood that the drawings are not to scale and that the disclosed embodiments are sometimes illustrated diagrammatically and in partial views. In certain instances, details that are not necessary for an understanding of the disclosed method and apparatus or that would render other details difficult to perceive may have been omitted. It should be understood that this disclosure is not limited to the particular embodiments illustrated herein.

DETAILED DESCRIPTION

Some embodiments will now be described with reference to the figures. Like elements in the various figures may be referenced with like numbers for consistency. In the following description, numerous details are set forth to provide an understanding of various embodiments and/or features. However, it will be understood by those skilled in the art that some embodiments may be practiced without many of these details and that numerous variations or modifications from the described embodiments are possible. As used here, the terms "above" and "below", "up" and "down", "upper" and "lower", "upwardly" and "downwardly", and other like terms indicating relative positions above or below a given point or element are used in this description to more clearly describe certain embodiments. However, when applied to equipment and methods for use in wells that are deviated or horizontal, such terms may refer to a left to right, right to left, or diagonal relationship, as appropriate.

Figure 1:
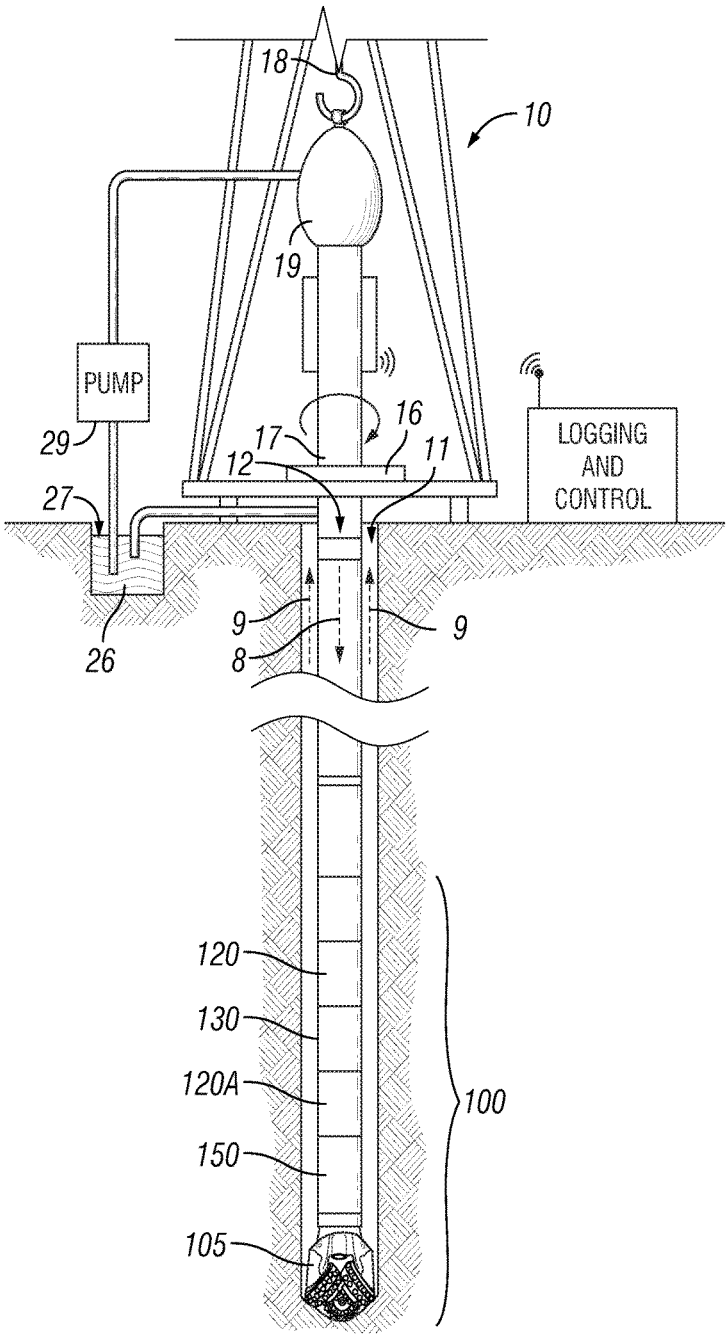
FIG. 1 (Prior Art)
FIG. 1 illustrates a well site system.

FIG. 1 illustrates a well site system in which various embodiments can be employed. The well site can be onshore or offshore. In this example system, a borehole 11 is formed in subsurface formations by rotary drilling in a manner that is well known. Some embodiments can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor 150, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 121. (References, throughout, to a module at the position of 120 can alternatively mean a module at the position of 121 as well.) The LWD module includes capabilities for measuring, processing, and storing information, as well as for communicating with the surface equipment. In the present embodiment, the LWD module includes a resistivity measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick/slip measuring device, a direction measuring device, and an inclination measuring device.

Figure 2:
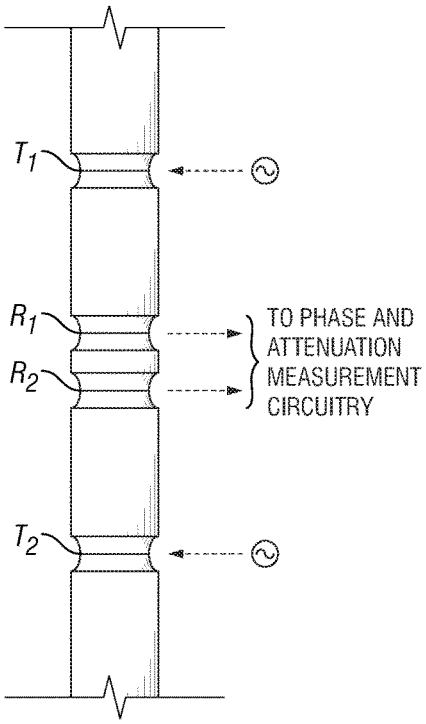
FIG. 2 (Prior Art)
FIG. 2 shows a prior art electromagnetic logging tool.

An example of a tool which can be the LWD tool 120, or can be a part of an LWD tool suite 121, is shown in FIG. 2. As seen in FIG. 2, upper and lower transmitting antennas, $T_1$ and $T_2$, have upper and lower receiving antennas, $R_1$ and $R_2$, therebetween. The antennas are formed in recesses in a modified drill collar and mounted in MC or insulating material. The phase shift of electromagnetic energy as between the receivers provides an indication of formation resistivity at a relatively shallow depth of investigation, and the attenuation of electromagnetic energy as between the receivers provides an indication of formation resistivity at a relatively deep depth of investigation. U.S. Pat. No. 4,899,112 can be referred to for further details. In operation, attenuation-representative signals and phase-representative signals are coupled to a processor, an output of which is coupleable to a telemetry circuit.

Recent electromagnetic (EM) logging tools use one or more tilted or transverse antennas, with or without axial antennas. Those antennas may be transmitters or receivers. A tilted antenna is one whose dipole moment is neither parallel nor perpendicular to the longitudinal axis of the tool. A transverse antenna is one whose dipole moment is perpendicular to the longitudinal axis of the tool, and an axial antenna is one whose dipole moment is parallel to the longitudinal axis of the tool. A triaxial antenna is one in which three antennas (i.e., antenna coils) are arranged to be mutually orthogonal. Often one antenna (coil) is axial and the other two are transverse. Two antennas are said to have equal angles if their dipole moment vectors intersect the tool's longitudinal axis at the same angle. For example, two tilted antennas have the same tilt angle if their dipole moment vectors, having their tails conceptually fixed to a point on the tool's longitudinal axis, lie on the surface of a right circular cone centered on the tool's longitudinal axis and having its vertex at that reference point. Transverse antennas obviously have equal angles of 90 degrees, and that is true regardless of their azimuthal orientations relative to the tool.

Drilling concerns include maintaining the balance of fluids and pressures between the borehole and formation and the efficient removal of cuttings from the borehole. Addressing those concerns can require modifications in drilling fluid density or viscosity, rate of penetration (ROP), rotational speed, and/or weight on bit, and must be accomplished in real time. Failure to do so can adversely affect the integrity/stability of the borehole and the safety of the rig crew.

The drilling fluid contains cuttings from the formations being drilled and therefore can provide information about those formations. This information enables decisions to be made about how the formations are to be, for example, logged, tested, or cored. Of particular interest is whether the pore spaces of the formation are filled with water, oil, or gas, or if pore spaces exist at all. In addition, many measurements made by measurement-while-drilling (MWD) or logging-while-drilling (LWD) tools are affected by the drilling fluid and must be corrected to account for those effects. Measured drilling fluid properties made downhole in real-time allow for more accurate corrections for those effects and thereby improve formation evaluation. Measuring the properties of drilling fluid returning to the surface from the bit allows, among other things, one to monitor the drilling process, characterize the formation being drilled, and steer the trajectory of the borehole for maximum benefit.

Historically, measurements of drilling fluid properties have taken place at the surface. Measurements of fluid and cuttings taken at the surface are inferior, less valuable, and less representative of the downhole environment due to the delay associated with the time it takes for the fluid to reach the surface (lag), the different velocities, properties, and temperatures of the fluid along the wellbore, and the fluid's related and changing ability to carry drilled solids (cuttings slip) and to "suspend" cuttings when circulation stops during the drilling. Recently, however, it has become possible for MWD/LWD tools to measure drilling fluid properties downhole. The availability of drilling fluid property information substantially immediately after a formation is drilled enables real-time operational decisions to be made along the lines discussed above. Collectively, these decisions impact the production potential of a reservoir. Generally, the earlier such decisions are made, the better. The applications discussed herein are based on the measured properties of the drilling fluid downhole as a function of time and/or depth and assist in the decision-making process.

For example, steering a borehole trajectory involves both determining the direction in which the well is to be drilled and how deeply it is to be drilled. The choices made in this area have implications for drilling operations and objectives. A borehole unintentionally entering a gas cap or a salt dome, for example, can cause the loss of the well, or a potential hydrocarbon reservoir can be missed.

Several applications of downhole drilling fluid measurements can assist drillers in making their drilling decisions and petrophysicists in evaluating formations of interest. Drilling fluid properties measured by sensors disposed downhole in MWD/LWD tools as a function of time and/or depth can be used to monitor the drilling process or infer properties of the formation being drilled. Specific embodiments of applications include detection of kicks, detection of shallow water flows, monitoring hole cleaning, identification of formation fluid type, determining lithologies, and environmental correction of logs. By providing an early indication of drilling conditions and formation properties, faster and even real-time decision-making is possible. The improved response time may impact drilling operations, formation evaluation, and reservoir production.

One embodiment involves fluid balance in the wellbore. For the purposes of this discussion, fluid balance encompasses those effects involving fluid from the formation entering the wellbore and vice versa.

Another embodiment is kick detection. During a kick, the pressure of the formation fluids exceeds that of the fluid in the borehole, and gas, water, or oil enters the wellbore and propagates to the surface. Those events are severe safety hazards. The earlier they can be detected and remedial actions initiated, the better, as the main principle of well control is to keep any uncontrolled influx volume to a minimum to reduce the pressures exerted on the wellbore as the influx is circulated to surface. Annular pressure-while-drilling (APWD) measurements can often detect these influxes, but this detection can be delayed in horizontal wells by the time it takes the invading fluid (e.g., gas) to propagate to a non-horizontal section. Local measurements of the mud properties, such as the density, on the other hand, allow one to detect kick-induced changes in the mud properties almost immediately. The magnitude of the density changes during kicks make detecting those kicks possible.

Another embodiment is shallow water flow detection. These flows can occur in deep-water wells in which rapidly deposited submarine fans or turbidite flows were covered with finer grained muds or shales. These deposited sands may experience significant overpressure but remain unconsolidated. If a drill bit penetrates such a formation, water-sand slurry can propagate up the wellbore and collect on the seafloor, which can result in the complete loss of the well. As with kick detection, water-sand slurry passing the mud measurement sensors is observable as a rapid change in apparent mud properties with time.

Another embodiment involves hole-cleaning As a borehole is drilled, cuttings are produced that must be transported to the surface if the borehole is to be extended any significant distance. If the cuttings are not cleared from the hole in a timely fashion, the drillstring can become stuck or packed off, possibly leading to its loss. This problem can be particularly severe in horizontal holes. The typical change in the mud properties due to drilled cuttings is small, but measurable. For a 12¼ in. hole drilled at 180 ft/hr with a flow rate of 1000 gal/min., the volume fraction of cuttings in the annulus is approximately 2%. In nominally 12 lb/gal mud loaded with 30 pu sandstone cuttings, the cuttings increase the mud density by 0.015 g/cm$^3$ (0.12 lb/gal.) and reduce the hydrogen index by 0.011.

Several alternative embodiments for hole-cleaning are possible. For example, one may look at hole-cleaning sweeps or lost-circulation material (LCM) pills. Detecting these sweeps is potentially very easy since they generally result in significant changes in the mud properties. Their effect on the cuttings loading in the neighborhood of the MWD/LWD tool can also be determined by comparing the mud properties before and after the sweep in cases where the cutting loading of the mud is high and bottoms-up circulation is performed before drilling ahead.

Another hole-cleaning application focuses on the cuttings alone. Direct measurements of the actual mud properties such as density or hydrogen index (HI) combined with inferred or measured properties of the unloaded mud can reveal information on the cuttings loading and the effectiveness of their removal at the surface. Comparison of the mud measurements before, during, and after connections can provide the same kind of information, and may also give some indication of cuttings bed formation (during connections, cuttings settle to the bottom of the hole, making the mud density at the top of the hole less) and cuttings bed movement when employing hole-cleaning and conditioning practices such as back-reaming and circulated "sweeps" of special high weight and/or viscosity "parcels" of fluid to assist movement of the drilled solids in the wellbore.

Yet another hole-cleaning embodiment works in combination with APWD, which measures the average cuttings load in the non-horizontal section. With those measurements, the movement of cuttings from the horizontal to the non-horizontal section of the wellbore can be tracked. This application of APWD measurements is a largely qualitative approach as the cuttings load is inferred and it is the relative changes in pressure readings that indicate the nature of the downhole condition.

When under conditions of good hole cleaning and very little cuttings dropout, the measured mud density can be used along with the known input mud density and the cuttings loading (as determined by rate-of-penetration (ROP) and porosity) to calculate the density of the cuttings themselves. This yields information on the type of lithology being drilled due to the unique densities of sandstone, limestone, dolomite and clay, and evaporites.

For more definite illustration, we provide some quantitative estimates of the effect of cuttings on mud density. Drilling at a ROP of X ft/hr, if the radius of the hole is r inches and assuming perfect hole cleaning (no cuttings slip), then the volumetric flow rate of cuttings per hour (matrix plus pore fluid) generated by drilling will be:

$$Q_{cuttings\,ft^3/hr}=\pi*(r_{in}^2/144)*X_{ft/hr} \quad (1.0)$$

or in t minutes, the volume of cuttings would be:

$$Q_{cuttings\ ft^3}=\pi*(r_{in}^2/144)*X_{ft/hr}*(t_{min})*(1_{hr}/60_{min}). \quad (1.1)$$

During this same time, the volume of mud that will pass through the bit, assuming pumping is being done at g gallons per minute (gpm), will be:

$$Q_{mud\ ft^3}=(0.134_{ft^3/gal})*(g_{gal/min})*(t_{min}) \quad (1.2)$$

Thus, if we assume that the hole cleaning is 100% (that all cuttings come up), the volume of circulated mud loaded with cuttings in the annulus in t minutes will be:

$$Q_{cuttings\ loaded\ mud\ ft^3}=Q_{cuttings\ ft^3}+Q_{mud\ ft^3} \quad (1.3)$$

$$=\pi*(r_{in}^2/144)*X_{ft/hr}*(t_{min})*(1_{hr}/60_{min})+(0.134_{ft^3/gal})*(g_{gal/min})*(t_{min}) \quad (1.4)$$

The fractional volume of cuttings ($V_c$) will thus be:

$$V_c=Q_{cuttings\ ft^3}/Q_{cuttings\ loaded\ mud\ ft^3} \quad (1.5)$$

$$=\pi*(r_{in}^2/144)*X_{ft/hr}*(t_{min})*(1_{hr}/60_{min})/(\pi*(r_{in}^2/144)*X_{ft/hr}*(t_{min})*(1_{hr}/60_{min})+(0.134_{ft^3/gal})*(g_{gal/min})*(t_{min})) \quad (1.6)$$

For example, with a ROP of 500 ft/hr and flow rate of 1100 gpm for a hole size of 12.25 inches, the cuttings percent by volume ($V_c$*100) would be 4.42%. Note that this equation is valid when there is no cuttings slip, no cuttings dropout, and no porosity destruction of the rock. The cuttings slip can be considered to be zero around the BHA where these fluid properties are being measured due to the high annular velocities, low annular volumes, and axial and lateral motions of the BHA that keep any cuttings from settling out. Porosity destruction can be accounted for in the equations by adding a (1-Φ) term, where Φ is the formation porosity. Also note the time factor ($t_{min}$) can cancel.

Once we know the cuttings by percent volume, we can calculate the cuttings density by:

$$\rho_mix_{ppg}=V_c*(\rho_cuttings_{gm/cm^3})*(8.345_{ppg/gm/cm^3})+(1-V_c)*(\rho_mud_in_{ppg}) \quad (1.7)$$

where $\rho_mix_{ppg}$ is the measured equivalent cutting loaded mud weight in parts per gallon (ppg), $V_c$ is the fractional volume of cuttings calculated above; ρ_cuttings is the bulk density of the formation in gm/cm$^3$, and ρ_mud_in is the clean mud density in ppg.

The term ρ_mud_in is normally measured at the surface and represents the mud density at surface conditions. As this mud travels down the interior of the drillpipe, it is subjected to temperature and pressure increases above the surface conditions at which it was measured, resulting in a change of its density by the time it exits the bit and travels up the annulus. It is therefore necessary to model the effects of pressure and temperature on this surface mud density in order to have the correct value to place in Eq. (1.7). From that equation, the density of the cuttings can be calculated.

Even if the pressure and temperature effects on the input mud are not modeled or known, we can still use Eq. (1.7) to gain an understanding of the effect of cuttings on the measured density or the change in the measured mud density that can be expected for a given change in formation or cuttings density.

Taking the derivative of ρ_mix with respect to ρ_cuttings in Equation (1.7), we get:

$$d(\rho_mix)/d(\rho_cuttings)=8.345V_c$$

or $$d(\rho_mix)=8.345V_c*d(\rho_cuttings)$$

Thus, with a change in cuttings bulk density of 0.3 gm/cc (or 2.5 ppg) for $V_c$ of 4.4%, for example, the expected change in the measured mud density of the mixture would be 0.0442*2.5=0.11 ppg (0.0442 is the fractional volume of cuttings calculated above).

The mud weight change would generally be more when drilling with a faster ROP as compared to a slow ROP. This is because the volume of cuttings coming up in a given volume of mud would be more in a given time due to the faster rate of penetration.

As an illustration, assuming all parameters, except ROP (X) are constant, $$d(\rho_mix)/d(X)=d(V_c)/d(X)*(8.345\rho_cuttings-\rho_mud_in). \quad (1.8)$$

Equation (1.5) can be written in the form:

$$V_c=aX/(b+aX) \quad (1.9)$$

where $a=\pi*(r_{in}^2/8640)$ and $b=(0.134_{ft^3/gal})*(g_{gal/min})$. Thus, $$d(Vc)/d(X)=a/(b+aX)-a^2X/(b+aX)^2=ab/(b+aX)^2 \quad (1.10)$$

and $$d(\rho_mix)/d(X)=ab/(b+aX)^2*(8.345\rho_cuttings-\rho_mud_in). \quad (1.11)$$

Thus, we can see from Equation (1.11) that the change in mud density for a unit change in ROP will always be positive, and so the mud density will increase with ROP. However, the gradient will decrease since this is an asymptotic relationship, so the amount of increase in mud density for a unit change in ROP will become smaller with increasing ROP.

Another embodiment involves formation fluid typing. One particular embodiment is based on a measurement of the mud density. By examining the measured mud density with respect to the rate of penetration (ROP), drilling fluid flow rate, and an assumed cuttings density, the density of the fluid contained within porous and permeable formations can be computed. To illustrate, consider the case of drilling through formations comprising alternating porous sandstones and shales. When the bit drills into sandstone, the cuttings are partially crushed and the porosity is removed. The amount of crushing will depend on the bit type which controls the relative amount of crushing versus shearing. Polycrystalline diamond compact (PDC) bits generally have more of a shearing than crushing action as compared to mill tooth and rock bits. Thus, for a porous sand, separate density terms for the matrix and fluid from the formation would be needed in Eq. (1.7). For shale, the use of the overall shale bulk density can be used directly because there is little-to-no crushing, and the pore spaces are small and non-flushable. Another consideration is the jetting effect of mud from the bit that can flush the formation fluid in the sand away from the borehole. The flushed formation fluids will then not enter the borehole. In what follows, we will consider two cases: one in which all formation fluid is flushed back, and another in which no part of the fluid is flushed.

For the volume of cuttings when drilling through a formation containing only a matrix mineral and porosity without regard to the pore volume and what it contains, the volumetric flow rate of cuttings and their fractional volumes generated at a ROP of X ft/hr in a borehole of radius r inches will be given using the previous Equations (1.0) through (1.7).

A more generalized set of equations that accommodates the pore volume of the formation and considers the type of fluid within the pores can be developed using the following equation, which gives the volumetric flow rate of the formation minerals or matrix or non-porous portion of the formation:

$$Q_{cuttings_matrix\ ft^3}\pi*(r_{in}^2/144)*X_{ft/hr}*(t_{min})*(1_{hr}/60_{min})*(1-\Phi_{fw}) \quad (2.0)$$

where $\Phi_{fw}$ is the non-clay porosity or volume percentage of free, non-clay water that is not associated with the clay minerals. It is assumed that any water filled pore volume within the clay (the clay bound water) is not destroyed. The term $(1-\Phi_{fw})$ has been added as compared to Equation 1.0 to allow an estimation of the fluid type that is contained within the pores using the mud density measurements. The drill bit may or may not destroy this porosity during the drilling process. Regardless, the volume associated with this porosity is preserved within the mud flowing in the annulus due to conservation of mass, and the contents will be measured by the mud density measurement.

The volume of the porosity contents coming into the borehole that is contained within the cuttings, if the porosity has not been destroyed, and likewise the volume coming into the borehole that was contained within the cuttings if the porosity is destroyed, would be:

$$Q_{cuttings_formation\ fluid\ ft^3}=\pi*(r_{in}^2/144)*X_{ft/hr}*(t_{min})*(1_{hr}/60_{min})*\Phi_{fw} \quad (2.1)$$

The total volume being added to the borehole would be:

$$Q_{cuttings\ loaded\ mud\ ft^3}=Q_{cuttings_matrix\ ft^3}+Q_{cuttings_formation\ fluid\ ft^3}+Q_{mud\ ft^3} \quad (2.2)$$

$$=\pi*(r_{in}^2/144)*X_{ft/hr}*(t_{min})*(1_{hr}/60_{min})*(1-\Phi_{fw})+\pi*(r_{in}^2/144)*X_{ft/hr}*(t_{min})*(1_{hr}/60_{min})*\Phi_{fw}+(0.134_{ft^3/gal})*(g_{gal/min})*(t_{min}) \quad (2.3)$$

Thus:

$$Q_{cuttings\ loaded\ mud\ ft^3}=\pi*(r_{in}^2/144)*X_{ft/hr}*(t_{min})*(1_{hr}/60_{min})+(0.134_{ft^3/gal})*(g_{gal/min})*(t_{min}) \quad (2.4)$$

which is equivalent to Equation 1.4, except the fractional components can now be more correctly sub-divided since the matrix and the pore volume have been distinguished from one another. The volume fraction of the matrix itself, $V_{c_}$matrix, for any given time period and for any general formation (e.g., a porous sandstone) is:

$$V_{c_}\text{matrix}=Q_{cuttings_matrix\ ft^3}/Q_{cuttings\ loaded\ mud\ ft^3} \quad (2.5)$$

$$V_{c_}\text{matrix}=\pi*(r_{in}^2/144)*X_{ft/hr}*(t_{min})*(1_{hr}/60_{min})*(1-\Phi_{fw})/[\pi*(r_{in}^2/144)*X_{ft/hr}*(t_{min})*(1_{hr}/60_{min})+(0.134_{ft^3/gal})*(g_{gal/min})*(t_{min})] \quad (2.6)$$

Also, the fractional volume of fluid contained within the pore volume, $V_{c_}$fluid, would be:

$$V_{c_}\text{fluid}=\pi*(r_{in}^2/144)*X_{ft/hr}*(t_{min})*(1_{hr}/60_{min})*\Phi_{fw}/[\pi*(r_{in}^2/144)*X_{ft/hr}*(t_{min})*(1_{hr}/60_{min})+(0.134_{ft^3/gal})*(g_{gal/min})*(t_{min})] \quad (2.7)$$

The density of the mixture flowing past the measurement sensor may be computed by realizing that the measured density is the mass-averaged density of the individual components in the mud as shown in Equation 2.7.1 below. Equation 2.7.1 includes a term 'F'. This is a flushing factor. It would be zero when the fluid is completely flushed and one when there is no flushing. Equation 2.7.1 represents a generalized form that is used to compute the volume-weighted average of the mud flowing in the annulus past the sensor, and accounts for the cuttings matrix or actual rock without the pore space included (first term in 2.7.1), the formation fluid remaining in the cuttings pore space as well as the mud that has replaced the formation fluid (second, third, and fourth terms in 2.7.1), and the mud flowing from the bit (fifth term in 2.7.1):

$$\rho_\text{mix}_{ppg}=V_{c_}\text{matrix}*(\rho_\text{matrix}_{gm/cm^3})*(8.345_{ppg/gm/cm^3})+F*V_{c_}\text{fluid}*(S_w)*(\rho_\text{free_water}_{gm/cm^3})*(8.345_{ppg/gm/cm^3})+F*V_{c_fluid}*(S_g)*(\rho_\text{gas}_{gm/cm^3})*(8.345_{ppg/gm/cm^3})+(1-F)*V_{c_}\text{fluid}*(\rho_\text{mud_in}_{gm/cm^3})*(8.345_{ppg/gm/cm^3})+(1-V_{c_}\text{matrix}-V_{c_}\text{fluid})*(\rho_\text{mud_in}_{gm/cm^3})*(8.345_{ppg/gm/cm^3}) \quad (2.7.1)$$

Equation 2.7.1 illustrates how to determine the density of the constituents within the mud flowing in the annulus. It can also be used to describe other material properties of the constituents given other mud measurements such as hydrogen index (HI), salinity, temperature, and volumetric photoelectric factor.

We shall now compare the mud density measurements when drilling a non-porous clay rich shale ($\Phi_{fw}=0$) to that when drilling a gas/oil-filled formation with and without flushing to determine the feasibility of using the measurement to distinguish between drilling shale and a porous formation containing various fluids. Assume $S_w$ is the water saturation of the pore space in the cuttings, ρ_shale is the density of shale (i.e., dry clay and other associated minerals without the clay bound water and having no free water), and ρ_ss is the density of zero porosity sandstone. $S_g$ is the saturation of gas in the pore space in the cuttings. $V_c$ is either the fractional volume of the shale matrix in the cuttings or the fractional volume of the sandstone in the cuttings, depending on what type of formation is being drilled, for this illustration. The variable ρ_mix, shale is the measured mud density when drilling a shale, ρ_mix_ss1 is the measured mud density when drilling a porous sandstone with no flushing (F=1) and ρ_mix_ss2 is the measured mud density when drilling a porous sandstone with full flushing (F=0). The term $\Phi_{sh}$ is the fractional volume of clay bound water in the shale. Then for drilling a shale or clay rich formation with no free water or effective porosity:

$$\rho_\text{mix_shale}_{ppg}=V_{c_}\text{matrix_sh}*(\rho_\text{shale}_{gm/cm^3})*(8.345_{ppg/gm/cm^3})+(1-V_{c_}\text{matrix_sh})*(\rho_\text{mud_in}_{gm/cm^3})*(8.345_{ppg/gm/cm^3}) \quad (2.8)$$

For drilling a clean formation with free water or effective porosity such as a sandstone having no flushing (F=1) of the pore space, the equation becomes:

$$\rho_\text{mix_ss1}_{ppg}=V_{c_}\text{matrix_ss}*(\rho_\text{ss}_{gm/cm^3})*(8.345_{ppg/gm/cm^3})+F*V_{c_}\text{fluid}*(S_)*(\rho_\text{free_water}_{gm/cm^3})*(8.345_{ppg/gm/cm^3})+F*V_{c_fluid}*(S_g)*(\rho_\text{gas}_{gm/cm^3})*(8.345_{ppg/gm/cm^3})+(1-V_{c_}\text{matrix_ss}-V_{c_}\text{fluid})*(\rho_\text{mud_in}_{gm/cm^3})*(8.345_{ppg/gm/cm^3}) \quad (2.9)$$

For drilling a clean formation with free water or effective porosity such as a sandstone having full flushing (F=0) of the pore space, the equation becomes:

$$\rho_\text{mix_ss2}_{ppg}=V_{c_}\text{matrix_ss}*(\rho_\text{ss}_{gm/cm^3})*(8.345_{ppg/gm/cm^3})+(1-F)*V_{c_}\text{fluid}*(\rho_\text{mud_in}_{gm/cm^3})*(8.345_{ppg/gm/cm^3})+(1-V_{c_}\text{matrix_ss}-V_{c_}\text{fluid})*(\rho_\text{mud_in}_{gm/cm^3})*(8.345_{ppg/gm/cm^3}) \quad (2.10)$$

The first term in the above equations is the contribution of the matrix in the cuttings that are generated. The second term in Equation (2.9) is the contribution of water contained within the formation cuttings. The term also contains a water saturation term because it is for a porous sandstone with no flushing of the pore space within the cutting. The third term in Equation (2.9) is for the residual gas in the cuttings. When the mud flushes into the formation, some of the oil/gas in the mud is pushed back and replaced by mud due to the effect of invasion. Thus, the saturation of oil/gas in the cuttings would not be the same as in the formation. The remaining part of the cuttings' porosity and the annulus will be full of mud. The last term is for the mud fraction circulating in the annulus, where ρ_mud_in is the density of clean mud without cuttings. When there is total flushing, then the entire fluid content inside the cuttings will be flushed back into the formation, and thus we would not have any fluid coming into the hole. Thus, Equation (2.10) does not have the second and third terms found in Equation (2.9).

To compute the change in effective mud density between shale and sand with various fluids to determine the sensitivity, we can simply subtract Equation (2.9) from Equation (2.8) for the case of drilling shale and then drilling a porous sandstone with no flushing of the pore space. Assuming the porosity of the sandstone is 35%, the matrix density of shale is 2.5 gm/cc, the density of water is 1 gm/cc and that of gas is 0.2 gm/cc, the water saturation is 20% and residual gas saturation is 80% (assuming no gas is replaced by mud because of jetting, F=1), and using an ROP 300 ft/hr and flow of 900 gpm:

$$V_c_\text{matrix}_sh=0.033 \text{ or } 3.3\%$$

$$V_c_\text{matrix}_ss=0.021 \text{ or } 2.1\%$$

$$V_c_\text{fluid}=0.012 \text{ or } 1.2\%$$

$$\rho_\text{mix}_\text{shale}_{ppg}-\rho_\text{mix}_ss1_{ppg}=0.178 \text{ ppg} \tag{2.11}$$

Although small, this change is detectable by, for example, Schlumberger's ADNVISION825 tool's mud density measurement, or by taking the difference between sequential pressure sensors in the drillstring and dividing by true vertical depth (TVD). Also note that this estimate does not assume any influx of gas into the mud system beyond that contained inside the cuttings. Additional gas will be released into the mud system as sections of gas-containing formations are broken down. This would be even truer if one drills into an over-pressured zone and has a gas influx into the wellbore. The actual mud density change may therefore be larger.

If we replace the gas with oil, and assume a density of 0.6 gm/cc for oil, then the difference in effective mud density is 0.148 ppg. Most often, oil has background and/or connection gases associated with it. These gases will further reduce the effective mud weight and make detection simpler. In addition, there might also be an influx of oil or gas into the hole (especially during pumps off) and this will make detection of mud density trends easier.

Now we calculate the difference in mud weights assuming there is total flushing. Thus, all fluid in the cuttings is flushed back into the formation. Again, similar to the calculations done earlier, but now subtracting Equations (2.10) from (2.8) and using:

$$Vc_\text{matrix}_sh=0.033 \text{ or } 3.3\%$$

$$Vc_\text{matrix}_ss=0.021 \text{ or } 2.1\%,$$

$$\rho_\text{mix}_\text{shale}_{ppg}-\rho_\text{mix}_ss2_{ppg}=0.117 \text{ ppg} \tag{2.12}$$

The value of clean mud density would be at the downhole temperature. Given below in Table 1 are the values of the differences calculated for drilling shale and then porous sandstone without flushing (col. 1) and with flushing (col. 2), depending on different values of clean mud density:

TABLE 1

| ρ_mud_in (ppg) | ρ_mix_shale $_{ppg}$-ρ_mix_ss1 $_{ppg}$ | ρ_mix_shale $_{ppg}$-ρ_mix_ss2 $_{ppg}$ |
|---|---|---|
| 8.34 | 0.178 | 0.117 |
| 9 | 0.178 | 0.109 |
| 10 | 0.178 | 0.098 |
| 12 | 0.178 | 0.075 |
| 16 | 0.178 | 0.029 |

A point worth noting here is that all values shown above are only valid for a ROP of 300 ft/hr and a flow rate of 900 gpm. For the case of no flushing of a gas-filled sandstone reservoir with 35% porosity and 80% gas saturation, and assuming the shale density to be 2.5 gm/cc, the density differences can be computed for various combinations of flow rates and ROP and are given in Table 2.

TABLE 2

| | ρ_mix_shale$_{ppg}$-ρ_mix_ss1$_{ppg}$ | | | | | | |
|---|---|---|---|---|---|---|---|
| ROP | Flow (gpm) | | | | | | |
| (ft/hr) | 600 | 700 | 800 | 900 | 1000 | 1100 | 1200 |
| 0 | 0 | 0 | 0 | 0 | 0 | 0 | 0 |
| 100 | 0.0907 | 0.0779 | 0.0683 | 0.0608 | 0.0548 | 0.0498 | 0.0457 |
| 200 | 0.1784 | 0.1536 | 0.1349 | 0.1203 | 0.1085 | 0.0988 | 0.0907 |
| 300 | 0.2633 | 0.2273 | 0.1999 | 0.1784 | 0.1611 | 0.1469 | 0.1349 |
| 400 | 0.3455 | 0.2988 | 0.2633 | 0.2353 | 0.2127 | 0.1941 | 0.1784 |
| 500 | 0.4251 | 0.3685 | 0.3252 | 0.2910 | 0.2633 | 0.2404 | 0.2212 |
| 600 | 0.5023 | 0.4363 | 0.3856 | 0.3455 | 0.3129 | 0.2860 | 0.2633 |
| 700 | 0.5771 | 0.5023 | 0.4446 | 0.3988 | 0.3616 | 0.3307 | 0.3047 |
| 800 | 0.6497 | 0.5666 | 0.5023 | 0.4511 | 0.4094 | 0.3747 | 0.3455 |
| 900 | 0.7201 | 0.6292 | 0.5586 | 0.5023 | 0.4563 | 0.4180 | 0.3856 |
| 1000 | 0.7886 | 0.6902 | 0.6137 | 0.5524 | 0.5023 | 0.4605 | 0.4251 |

Figure 3:
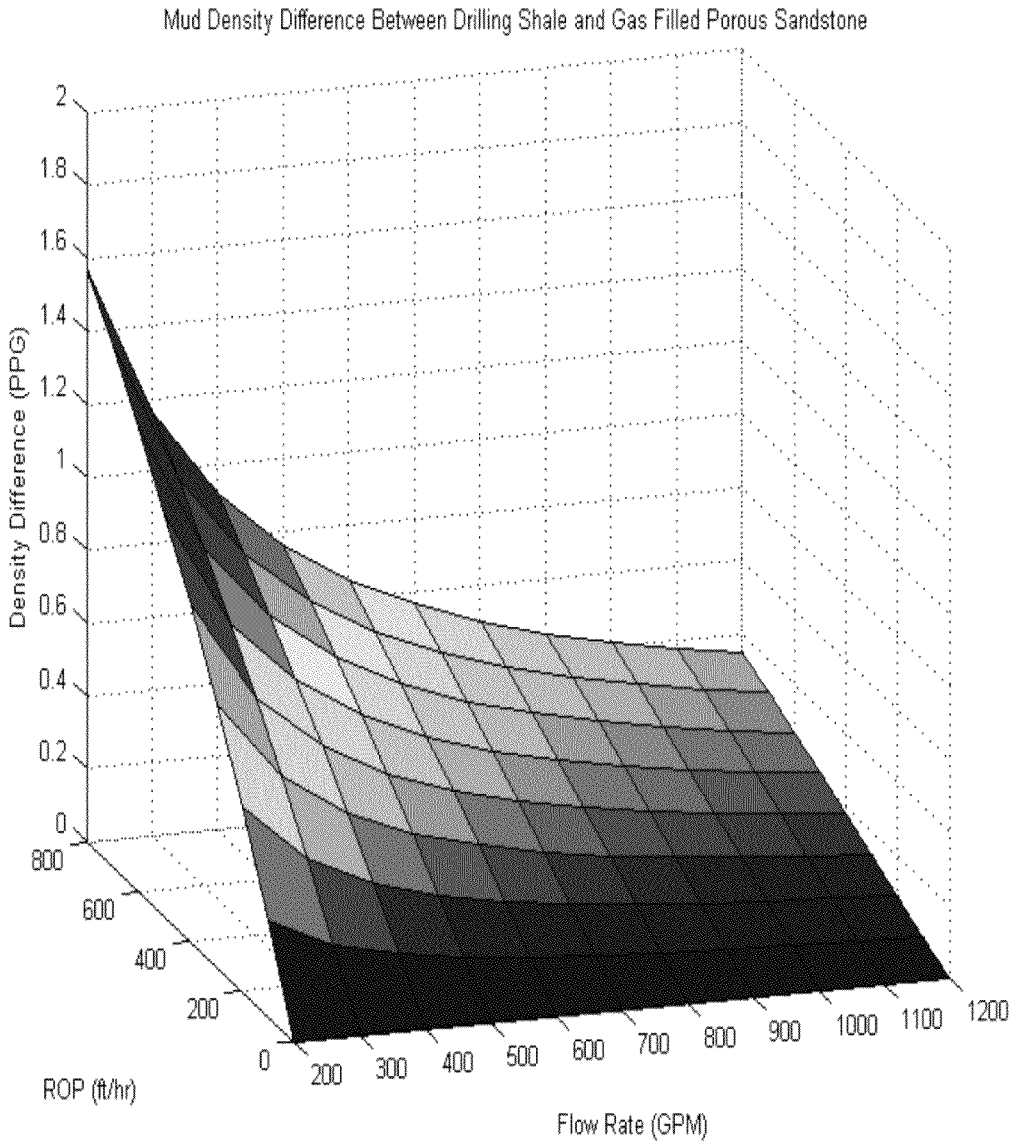
FIG. 3 shows a 3-dimensional plot of the density difference in mud versus the rate of penetration of the drill bit versus the flow rate of the drilling fluid (mud) for a gas-filled reservoir and assuming no flushing, in accordance with the present disclosure.
Figure 4:
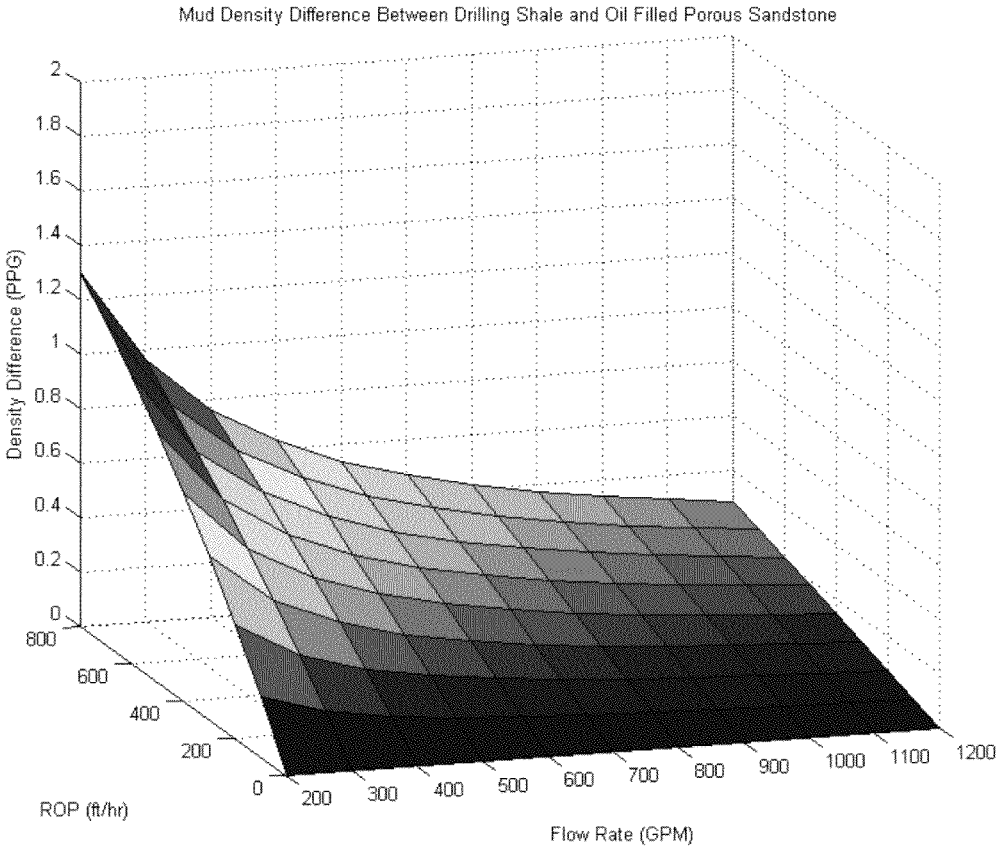
FIG. 4 shows a 3-dimensional plot of the density difference in mud versus the rate of penetration of the drill bit versus the flow rate of the drilling fluid (mud) for an oil-filled reservoir and assuming no flushing, in accordance with the present disclosure.

This data (with gas, no flushing) is plotted in FIG. 3. Using the same technique, but assuming oil in the reservoir without flushing, one may obtain the data plotted in FIG. 4.

Figure 5:
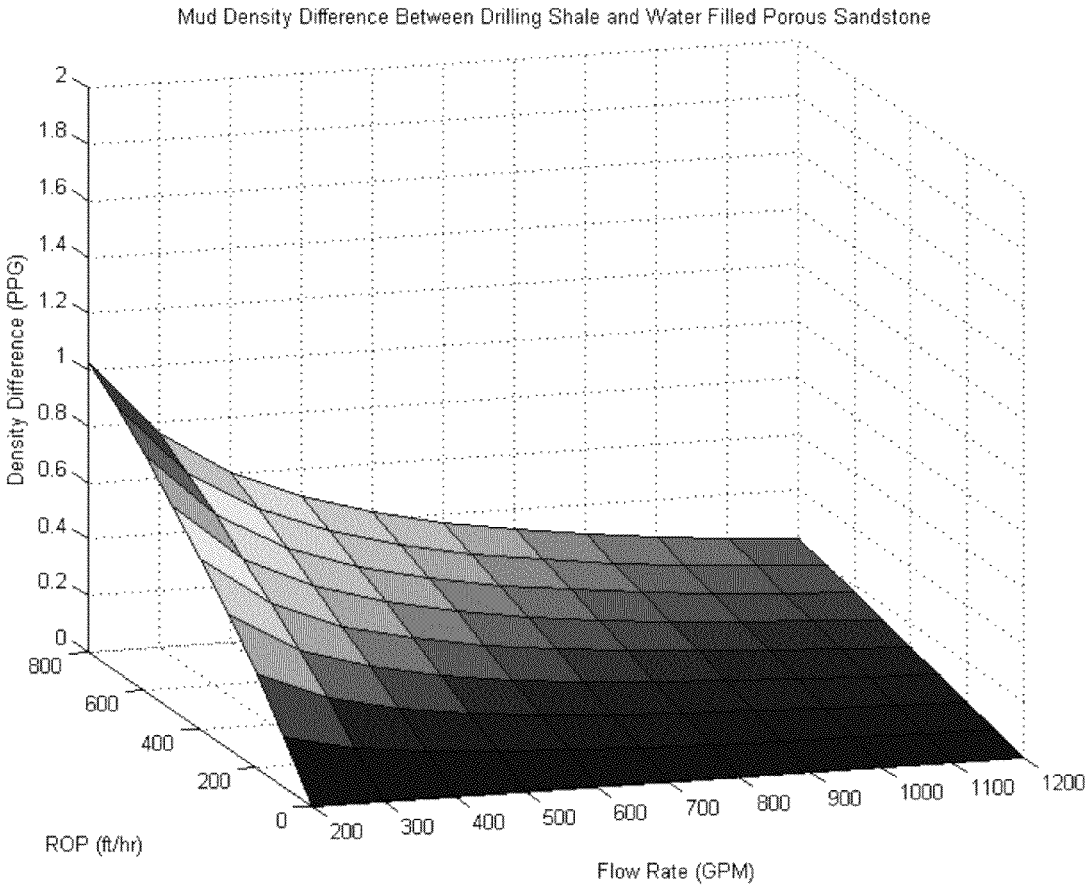
FIG. 5 shows a 3-dimensional plot of the density difference in mud versus the rate of penetration of the drill bit versus the flow rate of the drilling fluid (mud) for a water-filled reservoir and assuming no flushing, in accordance with the present disclosure.

Finally, assuming a wet sand zone, the resulting data is plotted in FIG. 5. For all cases, the change in mud density between drilling a shale and a porous formation with or without hydrocarbons in the pore space of the cuttings is detectable. Identifying the fluid type contained in the pore space of the cuttings is more difficult, but may be possible with a sufficiently accurate measurement.

It can also be envisioned that, if we assume the case of FIG. 5 could also represent a case of a gas or oil-filled formation with complete flushing, the Equations (2.0)-(2.10) can be solved for the density of the matrix material allowing one to distinguish between drilling shale, limestone, sandstone, halite, etc.

The following example is meant to illustrate the situation as computed in Table 2. That is, the results of drilling a shale and then drilling into a porous gas-filled sandstone while measuring the mud density of the mud mixture flowing past the sensor is shown in the log plots of FIGS. 11 and 12.

Figure 11:
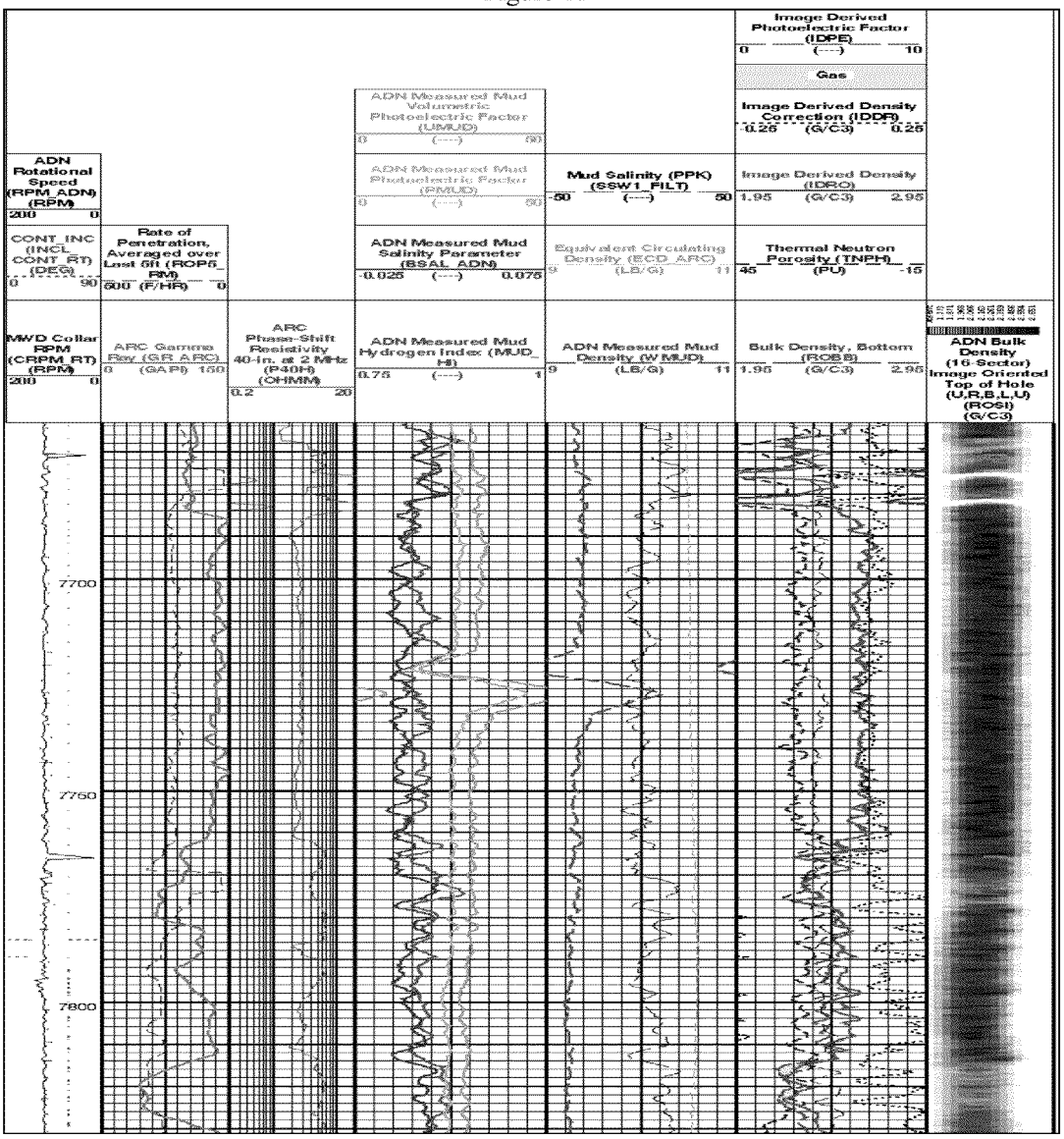
FIG. 11 shows a log plot that illustrates a mud density measurement along with other MWD/LWD measurements while drilling a borehole, in accordance with the present disclosure.

FIG. 11 illustrates the mud density measurement along with other MWD/LWD measurements while drilling a borehole. The depth track on the left of the figure is the depth track which contains inclination, CRPM (collar revolutions per minute) and ADN (Schlumberger Azimuthal Density-Neutron LWD tool) RPM. The other curve in the depth track is continuous inclination. The first track contains ROP (rate of penetration) and Gamma Ray for correlating formation changes. The second track contains the P40H (phase 40 inch spacing, 2 MHz) resistivity measurement. The third track contains the ADN8 borehole salinity, mud hydrogen index, Mud Volumetric Photoelectric factor (UMUD) and Mud Photoelectric factor (PMUD) that can also be used to derive formation and formation fluid characteristics similar in concept as those described in this application for the mud density measurement. The fourth track compares the mud density measurement and the Equivalent Circulating Density computed from the APWD (Annular Pressure While Drilling) pressure sensor. In addition to these, another curve (SSW1_FILT) is presented. This curve is the calculated water phase salinity of the mud in parts per thousand (ppk) from MUD_HI (mud hydrogen index) and BSAL_ADN (borehole salinity). The fifth track features ROBB (bottom quadrant compensated bulk density), IDPE (image derived photoelectric factor), IDDR (image derived compensated bulk density correction), IDRO (image derived compensated bulk density), and TNPH (thermal neutron porosity). The last track is the Compensated Bulk Density image that is used to quality check the density data based on the determined tool path as well as to determine the formation dip. A BHA is plotted to the right of the log to help visualize the sensor offsets for the ADN SS (short spacing density) sensor, where the mud density and photoelectric factor (pef) measurements are made, and the APWD measurement from the bit. The small radioactive sign on the ADN tool is the position of the short spacing (SS) detector and the neutron measurements that measure the mud hydrogen index. The red dot on the ARC tool (Schlumberger Array Resistivity LWD tool) is the position of the APWD measurement.

Figure 12:
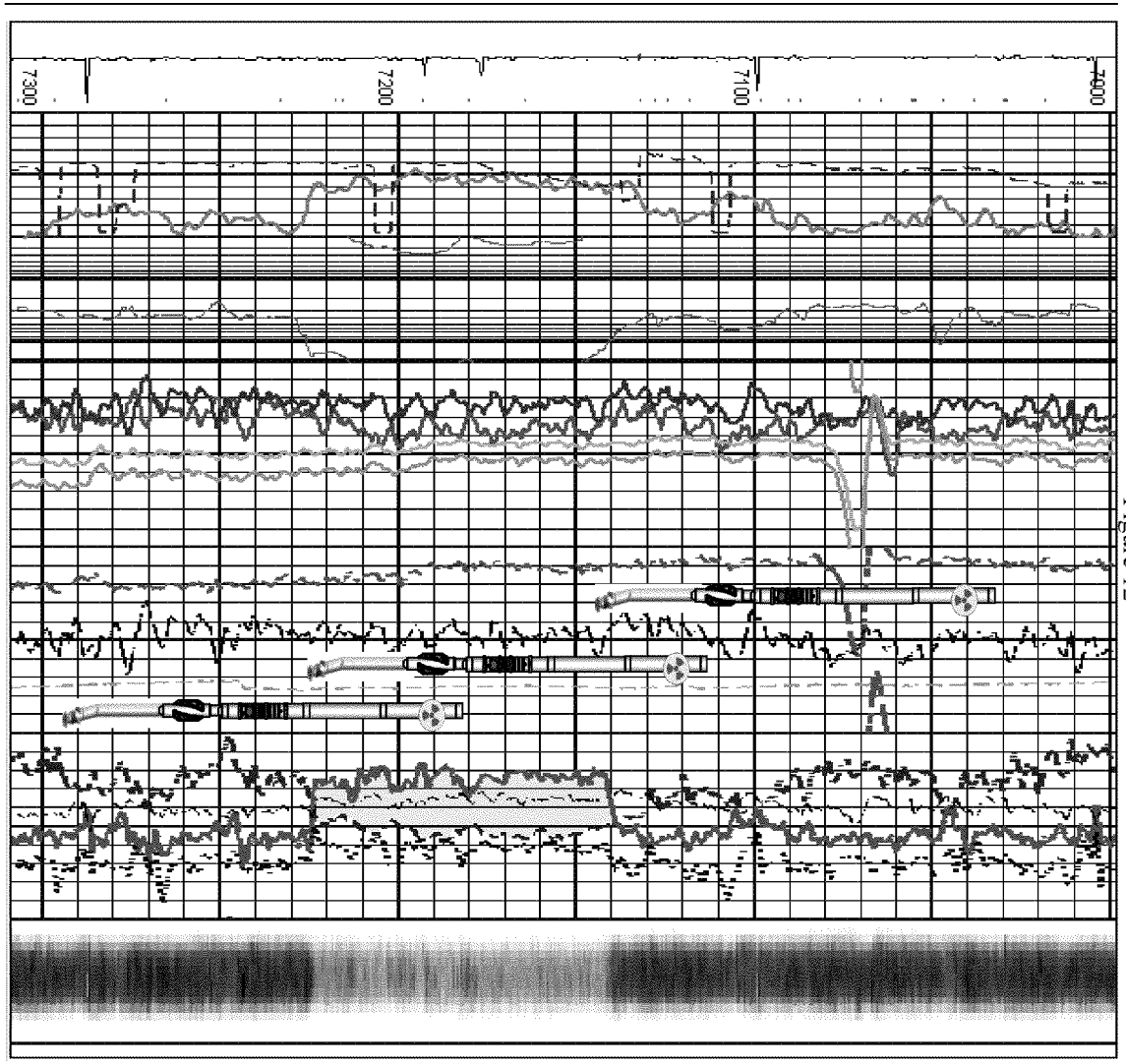
FIG. 12 shows a log plot in another interval in the same borehole as FIG. 11, but for which the drill string passes from a shale into a porous sand interval filled with gas, in accordance with the present disclosure.

The log plot in FIG. 12 shows another interval in the same well where the drill bit passes from a shale into a porous sand interval filled with gas. The gas was detected in the mud density measurements while drilling, as well as at the surface after it circulated up the annulus. The neutron-density separation (highlighted shaded section) is a typical measurement response in a gas filled porous sandstone. The sensor offset of the SS detector from the bit was 103 feet, as illustrated. The well was drilled with 10 ppg oil base mud (OBM). Note the values of mud density in track 4 starting at about 7030 feet. They decrease from about 9.25 ppg to 9.1-9.15 ppg as the bit penetrates the gas filled sand. A combination of low, then high, viscosity mud was circulated up the annulus when the sensor was at approximately 7060-7075 feet. The pumped pill causes a momentary change in the mud properties passing the ADN sensors and has fully passed by 7080 feet. The drop from 9.25 to 9.1 before the pill was pumped is attributed to the bit drilling the gas filled sand indicated by the shading between the neutron and density porosities in track 5. After the pill passes the ADN, the mud density stays at 9.1-9.15 ppg while the gas sand is being drilled. Note that the mud density gradually increases after 7120 feet by about 0.25 ppg from 9.15 ppg to about 9.4 ppg. This is because the bit re-entered a shale formation which has a higher bulk density than the gas-filled sandstone during this time frame. The difference in the bulk density of the shale versus gas-filled sandstone can be seen in track 5 by observing the ROBB curve is approximately 2.5 in shale and 2.15 in the gas-filled sandstone.

The drilling reports state that at 7295 feet (bit depth), the gas was circulated out before resuming drilling. The drilled gas had reached the surface by this time. We can clearly see the effect on the mud density at about 7190 feet (sensor depth when bit depth was 7295 feet) where the mud density increases from 9.2 to 9.4 ppg. This is a clear indication of the effect of drill gas on the mud density measurement.

The initial trend of drop in mud density that was observed at 7030 feet can be attributed to drilling the porous sand filled with gas when the bit entered it at about 7135 feet. The UMUD curve also increases slightly at 7190 feet. This is because the gas would cause the volumetric photoelectric absorption factor of the mud to decrease. UMUD increased once the gas was circulated out. This shows a powerful application of mud measurements where one can use mud density curve to identify that the bit has entered into a gas bearing reservoir even though the measurement is 103 feet behind the bit. (A sensitivity analysis of the effect of gas-filled cuttings on the mud density was discussed above.) This interval has a ROP of approximately 200-300 ft/hr as shown on the logs and a probable flow rate between 600-900 gpm. A sandstone porosity of 35 PU would have a density of 2.15. The formation properties and drilling situation closely resemble those modeled for Table 2. The expected mud density differences seen on the log and the computed mud density differences in Table 2 for 600-900 gpm and 200-300 ft/hr are approximately the same, corroborating the technique.

In cases where there is complete flushing of the gas, it becomes more difficult to distinguish the fluid content of the formation being drilled or the formation matrix density. However, when a gas influx occurs, the change in mud density will be even more dramatic.

Another embodiment uses the measured mud properties to correct measurements of formation properties. For example, a neutron porosity measurement is affected by mud density and salinity. Values measured downhole may be used for these corrections rather than values obtained at the surface. The downhole values should be more representative of the true conditions under which the tool is operating and therefore should provide more accurate environmental corrections.

Another embodiment detects sudden, large changes in the formation density at the bit because the cuttings affect mud density. This could be used, for example, to identify casing points for geostopping.

The drilling fluid properties that can be measured downhole include, but are not limited to, density, photoelectric factor (PEF), hydrogen index, salinity, thermal neutron capture cross section (Sigma), resistivity, slowness, slowing down time, sound velocity, and elemental composition. Changes in any of these measurements may be correlated with changes in fluid balance, hole cleaning, formation fluid properties, or environmental corrections. In addition, any or all of these drilling fluid measurements could be combined to improve the resulting answers.

Figure 6:
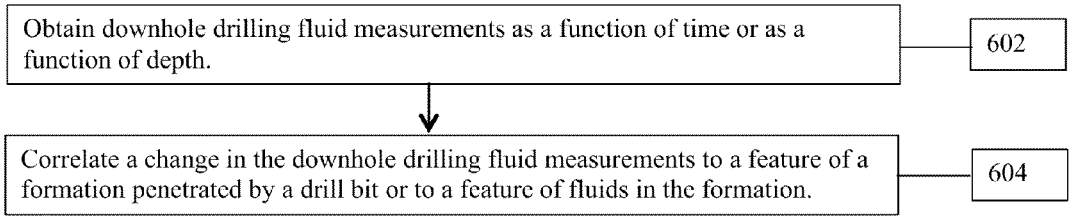
FIG. 6 is a flowchart showing an embodiment in accordance with the present disclosure.

FIG. 6 is a flowchart showing a particular embodiment disclosed herein. One may obtain downhole drilling fluid measurements as a function of time or as a function of depth (602) and correlate a change in the downhole drilling fluid measurements to a feature of a formation penetrated by a drill bit or to a feature of fluids in the formation (604).

Figure 7:
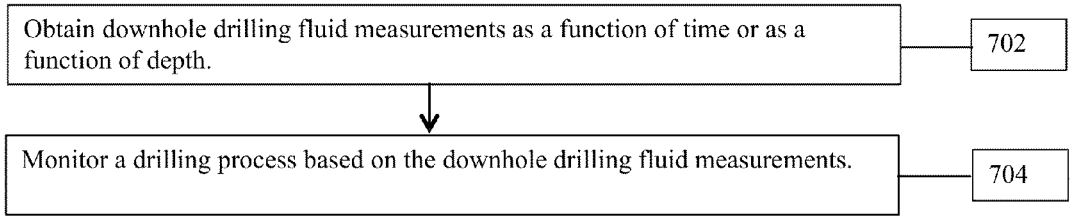
FIG. 7 is a flowchart showing an embodiment in accordance with the present disclosure.

FIG. 7 is a flowchart showing a particular embodiment disclosed herein. One may obtain downhole drilling fluid measurements as a function of time or as a function of depth (902) and monitor a drilling process based on the downhole drilling fluid measurements (904).

Figure 8:
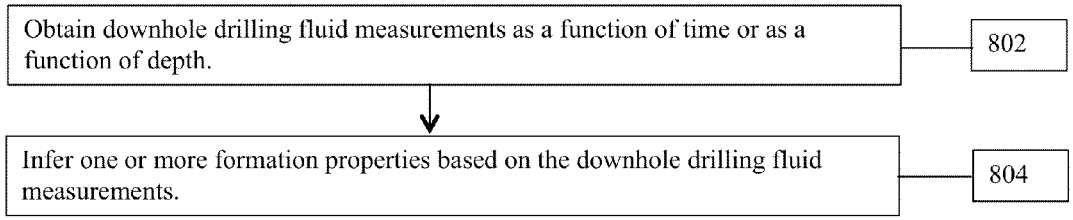
FIG. 8 is a flowchart showing an embodiment in accordance with the present disclosure.

FIG. 8 is a flowchart showing a particular embodiment disclosed herein. One may obtain downhole drilling fluid measurements as a function of time or as a function of depth (802) and infer one or more formation properties based on the downhole drilling fluid measurements (804).

Figure 9:
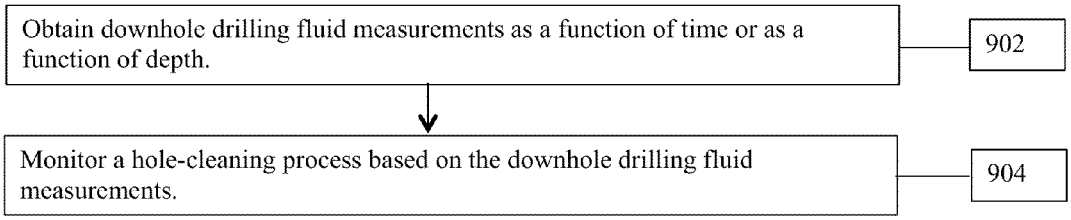
FIG. 9 is a flowchart showing an embodiment in accordance with the present disclosure.

FIG. 9 is a flowchart showing a particular embodiment disclosed herein. One may obtain downhole drilling fluid measurements as a function of time or as a function of depth (902) and monitor a hole-cleaning process based on the downhole drilling fluid measurements (904).

Figure 10:
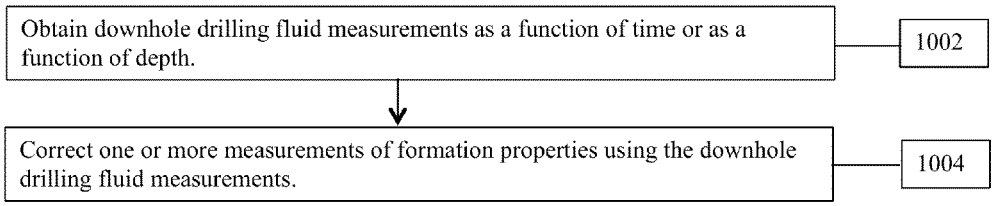
FIG. 10 is a flowchart showing an embodiment in accordance with the present disclosure.

FIG. 10 is a flowchart showing a particular embodiment disclosed herein. One may obtain downhole drilling fluid measurements as a function of time or as a function of depth (1002) and correct one or more measurements of formation properties using the downhole drilling fluid measurements (1004).

While only certain embodiments have been set forth, alternatives and modifications will be apparent from the above description to those skilled in the art. These and other alternatives are considered equivalents and within the scope of this disclosure and the appended claims. Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method of operating a well-site drilling system including a drill bit and fluid sensors, the method comprising:

positioning the fluid sensors in a wellbore of a formation;

obtaining downhole drilling fluid measurements using the sensors as a function of time or as a function of depth;

correlating a change in the downhole drilling fluid measurements to a feature of the formation penetrated by the drill bit or to a feature of fluids in the formation wherein the feature is used in controlling a drilling process including monitoring a hole-cleaning process, wherein an average cuttings load is measured in a non-horizontal section of a wellbore, and the movement of cuttings is tracked from a horizontal section of the wellbore to the non-horizontal section of the wellbore using the measured average cuttings load and the downhole drilling fluid measurements.

2. The method of claim 1, wherein the downhole drilling fluid measurements comprise density, photoelectric factor, hydrogen index, salinity, thermal neutron capture cross section (Sigma), resistivity, slowness, slowing down time, sound velocity, or elemental composition, or any combination thereof.

3. The method of claim 1, wherein the formation fluid type comprises water, oil, or gas, or any combination thereof.

4. The method of claim 1, wherein the formation fluid is flushed.

5. A method of operating a well-site drilling system including a drill bit and fluid sensors, the method comprising:

positioning the fluid sensors in a wellbore of a formation;

obtaining downhole drilling fluid measurements using the sensors as a function of time or as a function of depth; and monitoring a drilling process based on the downhole drilling fluid measurements; and making one or more drilling-decisions in real-time based on information obtained from the monitoring of the drilling process, wherein the one or more drilling-decisions are determined based at least in part on measuring an average cuttings load in a non-horizontal section of a wellbore, and tracking the movement of cuttings from a horizontal section of the wellbore to the non-horizontal section of the wellbore using the measured average cuttings load and the downhole drilling fluid measurements.

6. A method of operating a well-site drilling system including a drill bit and fluid sensors, the method comprising:

positioning the fluid sensors in a wellbore of a formation;

obtaining downhole drilling fluid measurements using the sensors as a function of time or as a function of depth;

monitoring a hole-cleaning process based on the downhole drilling fluid measurements; and measuring an average cuttings load in a non-horizontal section of a wellbore, and tracking the movement of cuttings from a horizontal section of the wellbore to the non-horizontal section of the wellbore using the measured average cuttings load and the downhole drilling fluid measurements.

7. The method of claim 6, wherein the monitoring comprises monitoring a volume fraction of cuttings.

8. The method of claim 6, wherein the monitoring comprises looking at hole-cleaning sweeps or lost-circulation material.

9. The method of claim 8, further comprising comparing a drilling fluid property before and after hole-cleaning sweeps, and determining a cuttings loading using the compared drilling fluid property.

10. The method of claim 6, further comprising comparing a direct measurement of a drilling fluid property with a corresponding inferred or measured property of unloaded drilling fluid, and determining a cuttings loading using the compared drilling fluid property.

11. A system, comprising:

a tool to be disposed in a wellbore;

a processor associated with said tool and configured to:

obtain downhole drilling fluid measurements as a function of time or as a function of depth;

correlate a change in the downhole drilling fluid measurements to a feature of a formation penetrated by a drill bit or to a feature of fluids in the formation wherein the feature is used in controlling a drilling process including monitoring a hole-cleaning process, wherein correlating the change in the downhole drilling fluid comprises measuring an average cuttings load in a non-horizontal section of a wellbore, and tracking the movement of cuttings from a horizontal section of the wellbore to the non-horizontal section of the wellbore using the measured average cuttings load and the downhole drilling fluid measurements.

12. The system of claim 11, wherein the measurement-while-drilling tool or a logging while-drilling tool comprises a tool that has sensors sensitive to drilling fluid properties.

* * * * *